United States Patent [19]

Parody

[11] Patent Number: 4,519,183

[45] Date of Patent: May 28, 1985

[54] METHOD AND MEANS OF BAGGING LOOSE TRASH

[76] Inventor: Ross Parody, 1 Story Acres, Essex, Mass. 01929

[21] Appl. No.: 520,562

[22] Filed: Aug. 5, 1983

[51] Int. Cl.[3] ..... B65B 11/00

[52] U.S. Cl. ..... 53/461; 53/464; 53/392; 294/156

[58] Field of Search ..... 428/122, 126; 224/158, 224/201, 265; 294/152, 156; 5/122; 53/390, 392, 461, 464

[56] References Cited

U.S. PATENT DOCUMENTS

| | | | |
|---|---|---|---|
| 1,559,046 | 10/1925 | McLeran | 294/152 |
| 3,167,227 | 1/1965 | Walden | 294/152 |
| 4,388,796 | 6/1983 | Zelnick | 53/390 |
| 4,471,600 | 9/1984 | Dunleavy | 53/390 |

*Primary Examiner*—John E. Kittle
*Assistant Examiner*—James J. Seidleck
*Attorney, Agent, or Firm*—Robert T. Dunn

[57] ABSTRACT

A sheet of flexible material such as fabric or plastic is provided with flaps, loops and ties so that it can be laid over a pile of loose material with rigid sticks attached to loops along two parallel edges of the sheet and the rigid sticks can be grasped by the user and forced together between the surface and the material forming an open ended envelope containing the material which is then turned over and the flaps at the end of the envelope pulled up and tied over the ends to close the envelope while the two sides made rigid by the sticks are tied together. Then the sticks may be removed leaving the flexible sheet formed into an envelope that encloses the material and so forming a bag containing the material for disposal.

5 Claims, 4 Drawing Figures

METHOD AND MEANS OF BAGGING LOOSE TRASH

BACKGROUND OF THE INVENTION

This invention relates to flexible bags containing loose trash, refuse, etc. and more particularly to method and means of bagging loose trash in a flexible sheet of plastic or cloth.

Disposable bags for containing trash are well know and provided in a variety of sizes and strengths of material. These bags are usually made of plastic and are open at one end for inserting trash into the bag and when the bag is substantially full, the open end is twisted closed and tied. The neck of the end that is twisted close is usually secured with a piece of wire and in this way the bag is closed. Trash contained in this way can then be disposed of readily.

Clearly, the steps taken to bag trash lying on the ground using such plastic bags is most easily accomplished by one person holding the bag and another picking up the trash and inserting it into the bag. However, it is very difficult for one person to do the whole job, because it takes two hands to pick up the trash and two hands to hold the bag open. It is one object of the present invention to provide a method and means for bagging loose trash lying on the ground which is readily manipulated by one person so that the trash is contained is a reasonably well closed envelope and can be disposed of readily.

It is another object to provide a method and means of bagging trash for easy disposal.

It is another object to provide means that can be manipulated by one person to bag loose trash lying on the ground in a reasonably secure envelope for easy disposal.

It is another object to provide a method using a sheet of flexible material whereby one person can bag loose trash lying on the ground in a reasonably secure package for easy disposal.

In accordance with the present invention a flexible plastic sheet having two parallel long sides and equipped with flaps extending from the short sides has loops and ties along the long sides so that rigid sticks or rods can be inserted by the user into the loops along the long sides and the sheet then laid over a pile of loose trash on the ground and the user then grasps the sticks on each side and forces them together between the material and the ground, forming an open ended envelope containing the material. The envelope is then turned over and the ties along the long sides are tied together. Then the sticks or rods are removed and the flaps at the ends are pulled up extending over the top of the envelope to close the envelope and they are secured in that position, leaving the sheet envelope containing the material secured for disposal.

These and other objects and features of the present invention will be apparent in view of the specific description of an embodiment of the invention taken in conjunction with the drawings in which:

EMBODIMENT OF THE INVENTION

Figure 1:
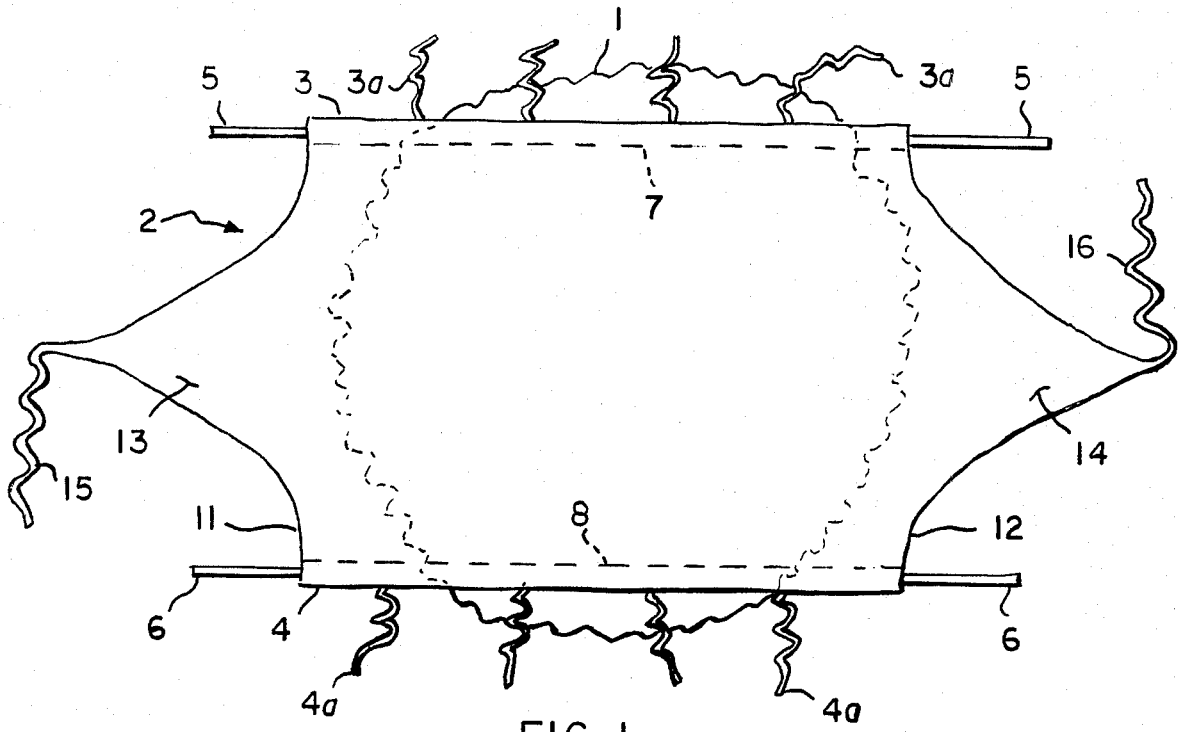
FIG. 1 is a top view showing the flexible sheet with rigid sticks attached to the long side thereof laid over a pile of loose trash on the ground.

FIG. 1 is a top view (looking downward) on a pile trash 1 on the ground. A flexible sheet 2 of the shape shown is laid on top of the trash, enclosing within the long sides 3 and 4 of the sheet as much of the trash as permitted by the dimensions of the sheet. Before the sheet is laid on the trash, the two long sides 3 and 4 are made substantially rigid. This can be done by inserting sticks or rods 5 and 6 thru loops or a channel like the channels 7 and 8 formed along the long edges. The channels 7 and 8 can be formed simply by doubling the edges of the sheet back and sealing (by heat or adhesive). Also along the edges 3 and 4, means are provided for attaching the two edges 3 and 4 together as described below. This can be done with strings such as the strings 3*a* along edge 3 and the strings 4*a* along edge 4.

The two shorter edges of the sheet that define the width, edges 11 and 12, each have a flap, (flaps 13 and 14, respectively) of substantially the shape, as shown, extending from the edge. The purpose of the flaps is to close the ends of the cylindrical tube defined by the sheet and so contain the trash in a closed bag as described more fully below. For this purpose, the flaps 14 and 15 may taper away from the body of the sheet into strings 15 and 16, respectively, so that the total length of each flap and string is at least half the dimension between the edges 11 and 12 (the length of the sheet).

Figure 2:
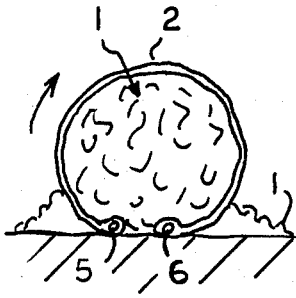
FIG. 2 is an end view showing the position of rigid sticks are forcibly moved to between the trash and the ground to form an envelope containing the trash before the envelope is turned over.
Figure 3:
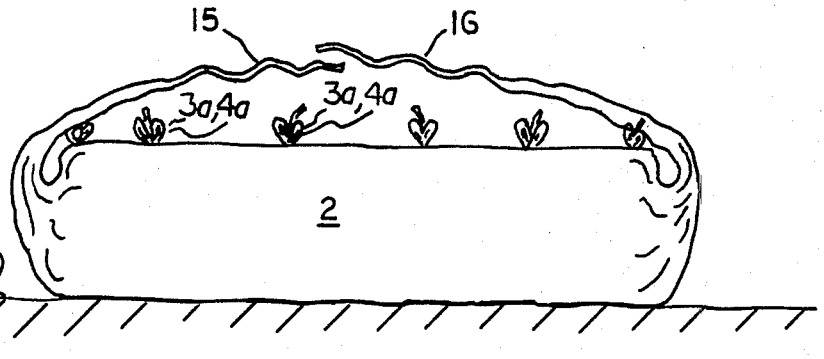
FIG. 3 is a front view showing the envelope turned over with the side flaps pulled up over the sides to the top of the envelope ready for tying.
Figure 4:
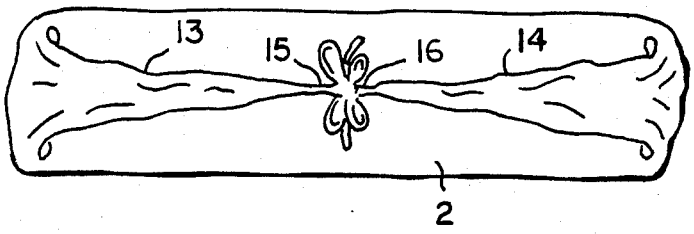
FIG. 4 is a top view showing the sheet tied up to secure the trash for disposal.

Before the sheet is laid on top of the pile of trash, the rods 5 and 6 are inserted into the channels 7 and 8 along the long edges of the sheet. Then the user grasps each of the long edges that are made rigid by the sticks (or grasps the protruding ends of the sticks, one in each hand) and moves the edges 3 and 4 downward against the ground and then together so that are contiguous and against the ground as illustrated in FIG. 2. At this point the sheet will define substantially a cylindrical envelope enclosing a portion of the trash. Then the user turns this envelope over and ties the two edges 3 and 4 together using the strings 3*a* and 4*a*, by tying each of the strings 3*a* to the immediately adjacent string 4*a*. Next, the sticks 5 and 6 can be removed and each of the flaps 13 and 14 are pulled up so that they close up the ends of the cylinder, all as shown in FIG. 3. Then the strings 15 and 16 that extend from the ends of the flaps are tied together at the top of the bundle. At this step, the trash is contained in a relatively securely closed envelope that looks from the top as illustrated by FIG. 4 and so the trash is bagged and can be disposed.

The essential parts of the structure contemplated by the present invention are the sheet so equipped that the long edges thereof can be made sufficiently rigid that they can be manipulated as described by laying the sheet over the trash forcing the long edges down against the ground and then together to define a cylindrical envelope as illustrated in FIG. 2 and means for closing the ends of that cylinder, preferably by extending flaps that are part of the sheet. Clearly, the technique of tying the edges of the sheet together and tying the flaps at the ends together across the top of the bundle all using strings constitute but one way of fastening the edges of the sheet together and closing up the ends of the cylindrical envelope. Each pair of strings that are tied together could be replaced by a single string and an eyelet or by a Velcro strip and pad. The technique of making the long edges 3 and 4 rigid by inserting rods could be done in another way. For example, the edges 3 and 4 could be simply be reinforced to the extent that they are rigid. These and other variations of the structure and technique could be substituted without deviating from the spirit and scope of the invention as set forth more fully in the claims.

What is claimed is:

1. A method of bagging loose material on a surface comprising the steps of:

(a) providing a flexible sheet having length and width to cover the material, of which two parralel long sides are rigid, (b) laying the sheet over the material, (c) moving the rigid long sides together between the surface and the material so that they are parallel and adjacent to each other and the sheet defines a cylindrical envelope enclosing the material, (d) turning the envelope over, (e) fastening the long sides together and (f) securing the ends of the envelope so that the material is contained within the envelope.

2. The method as in claim 1 wherein there are end flaps extending from the width sides of the sheet and the step (f) of securing the ends consists of folding the flaps over the ends of the envelope and securing them at the top of the envelope.

3. The method as in claim 1 wherein the long sides of the sheet are made rigid by attaching rigid rods thereto and the method includes the step of making those sides rigid by attaching the rigid rods to the long sides.

4. The method as in claim 1 wherein the long sides are equipped with strings therealong and the step (e) of fastening the long sides together consists of tying strings from one side to the other side.

5. The method as in claim 2 wherein the flaps are equipped with strings at the end thereof that reach the top of the envelope and they are secured at the top of the envelope by tying the strings.

* * * * *